US007007531B2

(12) United States Patent
Donhauser et al.

(10) Patent No.: US 7,007,531 B2
(45) Date of Patent: Mar. 7, 2006

(54) FORMING TOOL FOR HYDROMECHANICALLY DEEP-DRAWING WORKPIECES FROM SHEET METAL BLANKS

(75) Inventors: Christian Donhauser, Neufahrn (DE); Wolfgang Rauh, Kosching (DE)

(73) Assignee: Audi AG, Ingolstadt (DE)

( * ) Notice: Subject to any disclaimer, the term of this patent is extended or adjusted under 35 U.S.C. 154(b) by 218 days.

(21) Appl. No.: 10/469,582

(22) PCT Filed: Feb. 22, 2002

(86) PCT No.: PCT/EP02/01894

§ 371 (c)(1),
(2), (4) Date: Sep. 2, 2003

(87) PCT Pub. No.: WO02/070163

PCT Pub. Date: Sep. 12, 2002

(65) Prior Publication Data

US 2004/0074274 A1 Apr. 22, 2004

(30) Foreign Application Priority Data

Mar. 2, 2001 (DE) ..... 101 10 161

(51) Int. Cl.
*B21D 39/08* (2006.01)
*B21D 22/10* (2006.01)

(52) U.S. Cl. ..... 72/57; 72/60; 72/350; 29/421.1

(58) Field of Classification Search ..... 72/57, 72/60, 63, 350; 29/421.1

See application file for complete search history.

(56) References Cited

U.S. PATENT DOCUMENTS

| | | | | |
|---|---|---|---|---|
| 3,596,485 | A * | 8/1971 | Burk | 72/57 |
| 3,769,824 | A * | 11/1973 | Granzow | 72/57 |
| 4,314,468 | A | 2/1982 | Baril et al. | |
| 5,271,142 | A | 12/1993 | Moore et al. | |
| 6,481,256 | B1 * | 11/2002 | Beyer et al. | 72/57 |

(Continued)

FOREIGN PATENT DOCUMENTS

| | | |
|---|---|---|
| DE | 416520 | 7/1966 |

(Continued)

*Primary Examiner*—David Jones
(74) *Attorney, Agent, or Firm*—Stevens, Davis, Miller & Mosher, LLP

(57) ABSTRACT

A forming tool (1) for hydromechanically deep-drawing workpieces from sheet metal blanks (2), the tool comprising a water tank (3), which acts as a lower tool and can be filled with a liquid active medium (8), thus forming the drawing die. The tool is also provided with a drawing ring (10), which is located in the upper section of the water tank (3) and is sealed against a volume of the active medium lying below. The boundary of the ring aperture (11) of the drawing ring (10) forms a drawing edge for the workpiece (2). The forming tool also comprises a drawing punch (9), which can be displaced with the sheet metal blank (2) interposed, through the ring aperture (11) of the drawing ring (10) into the section containing the active medium (8), whereby the sheet metal blank is pressed onto the drawing punch (9) using a reaction pressure as the application pressure, by means of a targeted displacement of the active medium (8). According to the invention, a water tank insert (14), which can be filled with active medium (8) to leave free the remaining water tank volume, can be positioned in the water tank (3), whereby the ring section of the drawing ring (10) lies tightly on the upper edge of the lateral walls (15, 16, 19, 20) of the insert.

8 Claims, 2 Drawing Sheets

U.S. PATENT DOCUMENTS

| | | | | |
|---|---|---|---|---|
| 6,513,359 | B1 * | 2/2003 | Binder et al. | 72/57 |
| 6,519,992 | B1 * | 2/2003 | Schnupp | 72/57 |
| 6,631,630 | B1 * | 10/2003 | Pourboghrat et al. | 72/60 |

FOREIGN PATENT DOCUMENTS

| | | |
|---|---|---|
| DE | 1 552 070 | 11/1969 |

* cited by examiner

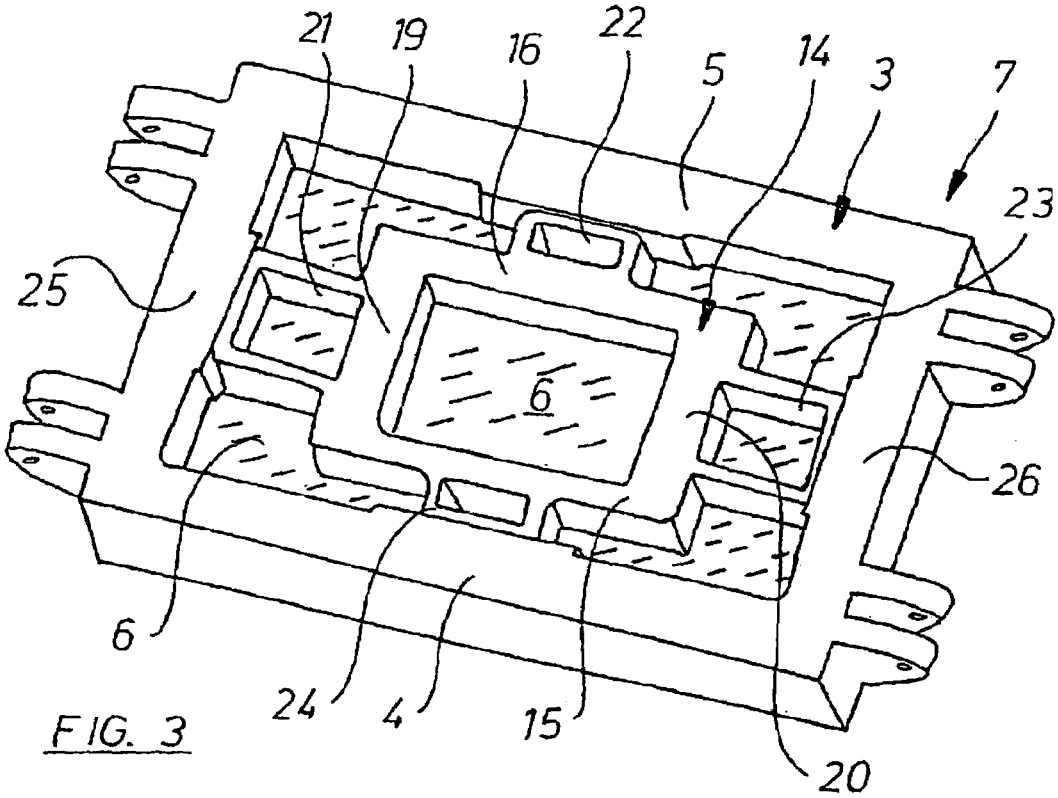
FIG. 3
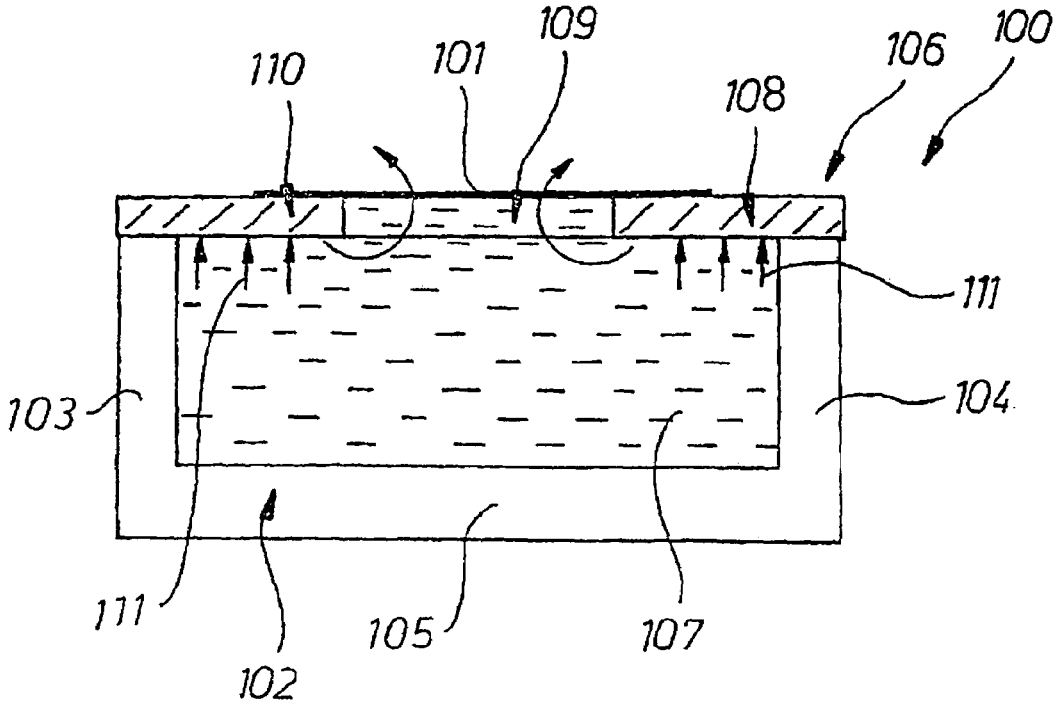
FIG. 4 ( STATE OF THE ART

FORMING TOOL FOR HYDROMECHANICALLY DEEP-DRAWING WORKPIECES FROM SHEET METAL BLANKS

FIELD OF INVENTION

The invention relates to a forming tool for hydromechanically deep-drawing workpieces from sheet metal blanks as specified in the claims.

BACKGROUND OF THE INVENTION

A disclosed generic shaping tool (publication BLECH [SHEET METAL], No. 9/1963, page 575, FIG. 7) consists essentially of a water tank, a drawing ring and drawing punch, and an actuatable blank holder.

The water tank is designed with side walls and a bottom which as lower tool may be filled with a liquid active medium and thus forms the drawing die. The drawing ring is plate-shaped in design and is mounted in the upper area of the water tank. It may be sealed by its ring area from a subjacent active medium volume. The edge of the ring aperture of the drawing ring forms a drawing edge for the workpiece.

The drawing punch is designed as to be movable by means of an adjustable driver rod so that it may be displaced to the area of the active medium, with the sheet metal blank interposed, through the ring aperture of the drawing ring. The movable blank holder serves as mounting support of the edges of the sheet metal blank introduced, the holding pressure selected being such that the possibility is provided of sliding of the edges of a sheet metal blank when a load is applied to the sheet metal blank by the drawing punch.

Specifically, the ring area of the drawing ring in this instance fits tightly against the upper edge of the side walls of the water tank. In addition, the blank holder presses the edge area of the sheet metal blank against a seal engaged in the drawing ring and accordingly seals the system containing the active medium off from the exterior. In the drawing process the drawing punch extends into the active medium, generally a water-oil emulsion, with the sheet metal blank interposed, as a result of which this medium is displaced by way of an adjustable throttle. The reaction pressure obtained as a function of the throttle position causes the sheet metal blank to be pressed against the drawing punch, as a result of which a workpiece of suitable shape may be produced.

A single shaping tool may be used to produce different workpieces with a water tank of predetermined size by replacement and use of different drawing rings each with a different ring aperture and of adjusted drawing stamp size. The following problems may arise in this instance.

With relatively large workpieces the ring area of the drawing ring rests on the side walls of the water tank so that the ring extends only a short distance above the side walls of the water tank. In the shaping process and with build-up of pressure in the active medium this medium exerts pressure upward over this short distance, but because of the small width of the area involved this pressure can be controlled by simple means and does not cause appreciable deformation of the drawing ring. The situation is different in production of a smaller workpiece in which use is made of a drawing ring with relatively smaller ring aperture, the water tank rigidly integrated into the shaping tool being used in this instance as well. The area of the drawing ring in this situation extends a considerable distance above the supports on the side walls of the water tank above the active medium toward the center of the water tank. During the shaping process the pressure in the active medium consequently exerts considerable force on the extension vertically upward on the drawing ring. This can result both in permanent deformation of the drawing ring during the shaping process and/or in elastic deformation of the drawing ring during the forming process as a sort of "breathing," so that the quality of output and reproducibility may be adversely affected and uncontrolled in workpiece production. Such deformation could perhaps be prevented by higher stability of such a drawing ring, but the thickness of the drawing ring plate would have to be increased in comparison to drawing rings having smaller ring apertures. This would result in unfavorably higher production costs and higher weights associated with difficulties in drawing ring replacement, to which would have to be added inconvenient adjustments of the blank holder positions and drawing punch paths to drawing rings of different sizes.

SUMMARY OF THE INVENTION

The object of the invention accordingly is further to develop a generic shaping tool so that deformation of the ring area during the shaping process is largely prevented when use is made of drawing rings with ring apertures relatively smaller than that of the surface of the water tank.

This object is attained with the characteristics outlined in the many claims.

A first embodiment specifies that the shaping tool comprises at least one water tank insert in the water tank integrated into the tool, an insert which may be filled with an active medium while the water tank volume surrounding it is kept clear. The ring area of the drawing ring employed rests tightly on the upper edge of the side walls of the insert, preferably a rotating seal being mounted for this purpose on the upper edge of the walls of the insert.

A free extension of a ring area of the drawing ring currently in use with small ring aperture is obviously reduced in comparison to the support initially described on the water tank side walls. As a practical feature several water tank inserts of different surface area are available which may be combined with different drawing rings so that only slight free ring area extensions are present, and accordingly the pressure in the active medium exerts only a slight force in the direction of "breathing" of the drawing ring.

It is thus an advantage that, while the tool-integrated relatively large water tank is retained, the same shaping may also be used for production of relatively small workpieces without occurrence of the problem of pressure-determined deformation of the drawing ring such as "breathing" entailing lowering of production quality. The water tank insert proposed may also be produced cost effectively and by simple means and may be installed in the water tank quickly and by simple means when a drawing ring is replaced.

In another preferred embodiment of the invention the water tank insert is tubular with insert side walls which may be mounted on the bottom of the water tank by way of at least one circumferential lower wall edge seal to effect sealing. Connections mounted inside the water tank insert on the bottom of the water tank for the active medium may thus be additionally used appropriately as described here for use of the water tank as a whole.

As an alternative, the water tank insert may also be produced as an insert container with its own bottom insert; connections for the active medium are to be provided in this instance on the container insert side.

In another preferred embodiment the insert side walls are of the same height as the tank side walls of the water tank integrated into the shaping tool. Consequently, all drawing rings which may be used are positioned at the same level in the shaping tool, so that the tool settings may be retained more or less even in the case of drawing ring replacement in conjunction with use of a water tank insert.

It is proposed in accordance with a further embodiment that spacers be mounted on the exterior of the insert side walls a certain distance from adjacent interior sides of walls of the water tank so that the water tank insert may be positively locked in the water tank. As an advantageous result, the respective water tank insert employed is immovable and always held in the same position in the water tank.

A universal blank holder is formed on the shaping tool, a holder which may be moved from an open position to a retaining position, the support areas being mounted more or less above the side walls of the water tank, since the edges of the blank to be retained are positioned there when the entire water tank volume with a drawing ring with large ring aperture is used. In the event of replacement and use of a smaller drawing ring with smaller ring aperture in conjunction with a water tank insert, the edges of a correspondingly smaller blank to be retained by the blank holder obviously are positioned further toward the center of the water tank. Since the universal blank holder with its positioning drive is to continue to be used in this situation as well, a still further embodiment proposes that the blank holder include in addition to the universal blank holder a replaceable blank retaining ring, the ring aperture of which corresponds more or less to that of the respective drawing ring. The blank retaining ring is directly or indirectly detachably connected to the universal blank holder. As a result, the regulating distance and the retaining force of the universal blank holder are diverted further toward the center of the water tank in the area of the water tank insert relevant in this instance and the relatively small ring aperture of the current drawing ring.

Even here inelastic and/or elastic deformation of the blank holder ring may occur as a result of engagement of the retaining force of the universal blank holder radially further outward on the blank holder ring and of location of the supporting force radially farther inward on the edge of the blank. If, depending on the circumstances, such a problem occurs, another embodiment proposes that the respective plate retaining ring be detachably connected to a stationary receiving ring, the ring aperture of the receiving ring being at least as large as that of the plate retaining ring. The stationary receiving ring is detachably connected on its ring side areas to the universal blank holder. The forces arising in the blank holder are accordingly absorbed more or less in the stationary receiving ring without causing deformation. The receiving ring may be used as another universal component to which different plate retaining rings may be detachably connected. Only if a drawing ring aperture is larger than the ring aperture of the receiving ring is the latter to be replaced as well.

Consequently, as a general rule a generic shaping tool may be used universally for production of workpieces of different sizes with high production quality, with only few replacements of workpiece-specific components.

BRIEF DESCRIPTION OF THE DRAWINGS

The invention is discussed in detail with reference to several drawings, in which.

DETAILED DESCRIPTION OF THE INVENTION

Figure 1:
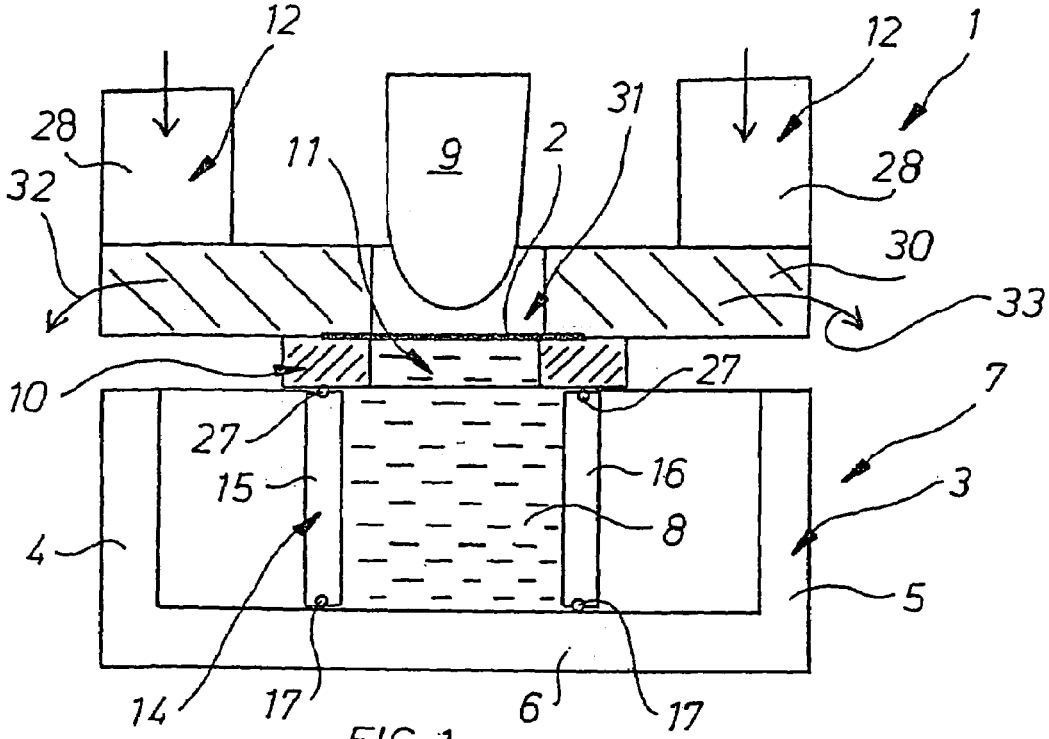
FIG. 1 presents a diagram of a shaping tool as claimed for the invention for hydromechanical deep drawing of workpieces of blanks, in a first embodiment, FIG. 2 a diagram of a shaping tool claimed for the invention for hydromechanical deep drawing of workpieces of blanks in an alternative embodiment, FIG. 3 a diagrammatic perspective top view of a water tank insert, and FIG. 4 a diagram of a partial area of a shaping tool of the state of the art for hydromechanical deep drawing of workpieces from blanks.

FIG. 4 presents in diagram form an example of a tool section 106 as part of a shaping tool 100 in the state of the art. This lower tool 106 comprises a water tank 102 with tank side walls 103, 104 and a tank bottom 105, the water tank 102 being filled with a liquid active medium 107 such as for example a water-oil emulsion and thereby forming the drawing die. A drawing ring 108 is plate-shaped in this example and is mounted in the upper area of the water tank 102. It is sealed off by its ring area from a subjacent volume of active medium. The edge of the ring aperture of the drawing ring 108 forms a drawing edge for the workpiece 101. A drawing punch not shown here may be moved by an adjustable driver rod also not shown here so that it may be displaced, with the workpiece 101 interposed, through a ring aperture 109 of the drawing ring 108 into the area of the active medium 107. In this drawing process the drawing punch penetrates the active medium 107 with the workpiece 101 as blank interposed, as a result of which this medium is displaced by way of an adjustable throttle not shown here. The reaction pressure obtained as a function of the position of the throttle then causes the blank to be pressed against the drawing punch, as a result of which a workpiece of suitable shape may be produced. In FIG. 4 the workpiece 101 is relatively small, so that the ring aperture 109 of the drawing ring 108 is also relatively small. As is also to be seen in FIG. 4, the drawing ring 108 extends a considerable distance 110 from the supports on the side walls of the water tank 103, 104 above the active medium 107 toward the center of the water tank. Consequently, during the shaping process the pressure indicated by the arrows 111 in the active medium 107 exerts a significant force vertically upward on the drawing ring 108. This may result in breathing of the drawing ring 108 during the shaping process, so that the production quality and reproducibility are unfavorably and uncontrollably affected in workpiece production.

In order to eliminate this problem of breathing this invention proposes a shaping tool 1 by means of which the problems referred to above can be prevented. As is to be seen in FIG. 1, the shaping tool 1 for hydromechanical deep drawing of a workpiece 2 consists of a sheet metal blank, a water tank 3 with tank side walls 4, 5, and a tank bottom 6, which as lower tool 7 may be filled with a liquid active medium 8 and thereby forms the drawing die.

This shaping tool 1 also comprises a drawing punch 9 which may be moved by an adjustable driver rod not shown here; this drawing punch 9, with the blank 2 interposed, may be displaced through a ring aperture 11 of a drawing ring 10 into the area of the active medium 8.

An actuatable blank holder 12 is also provided for mounting the edges of the sheet metal blank 2 to be shaped, along with the possibility of sliding when a retaining pressure allowed by the drawing punch 9 is applied.

As is also to be seen in FIG. 1, there is introduced into the water tank 3 a water tank insert 14 which may be filled with the active medium 8, the remaining volume of the water tank being kept free.

A perspective top view, in the form of a diagram, of the water tank 3 with water tank insert 14 is presented in FIG. 3. It is to be seen that the water tank insert 14 is tubular in shape. As is to be seen in turn in FIG. 1, the side walls 15, 16 of the water tank insert are mounted on the water tank bottom 6 by way of a circumferential lower wall edge seal 17 shown only in extremely schematic form. The height of the insert side walls 15, 16 corresponds to the height of the tank side walls 4, 5.

As is to be seen in FIG. 3 in particular, there are mounted on the exterior of the insert side walls 15, 16, 19, 20 of the water tank insert 14 spacers 21, 22, 23, 24 separating these side walls from the adjacent interior sides of the tank side walls 4, 5, 25, 26 so that the water tank insert 14 may be positively locked in the water tank 3.

As is to be seen in FIG. 1, the ring area of the drawing ring 10 fits tightly on the upper edge of the insert side walls 15, 16, sealing being effected by way of a circumferential upper wall edge seal 27, as is shown only very schematically as an example. Comparison of FIG. 1 with FIG. 4, which reflects the state of the art, shows that the free projecting length of a ring area is substantially reduced in the case of a drawing ring 10 with a small ring aperture 11 by the water tank insert 14 as claimed for the invention, so that the pressure in the active medium 8 can apply only a slight force toward "breathing" of the drawing ring 10 in the shaping process.

As is also to be seen in FIG. 1, the blank holder 12 consists of a universal blank holder 28 and a replaceable blank retaining ring 30 whose ring aperture 31 corresponds more or less to that of the associated drawing ring 10 and whose ring area is detachably connected directly to the universal blank holder 28.

Figure 2:
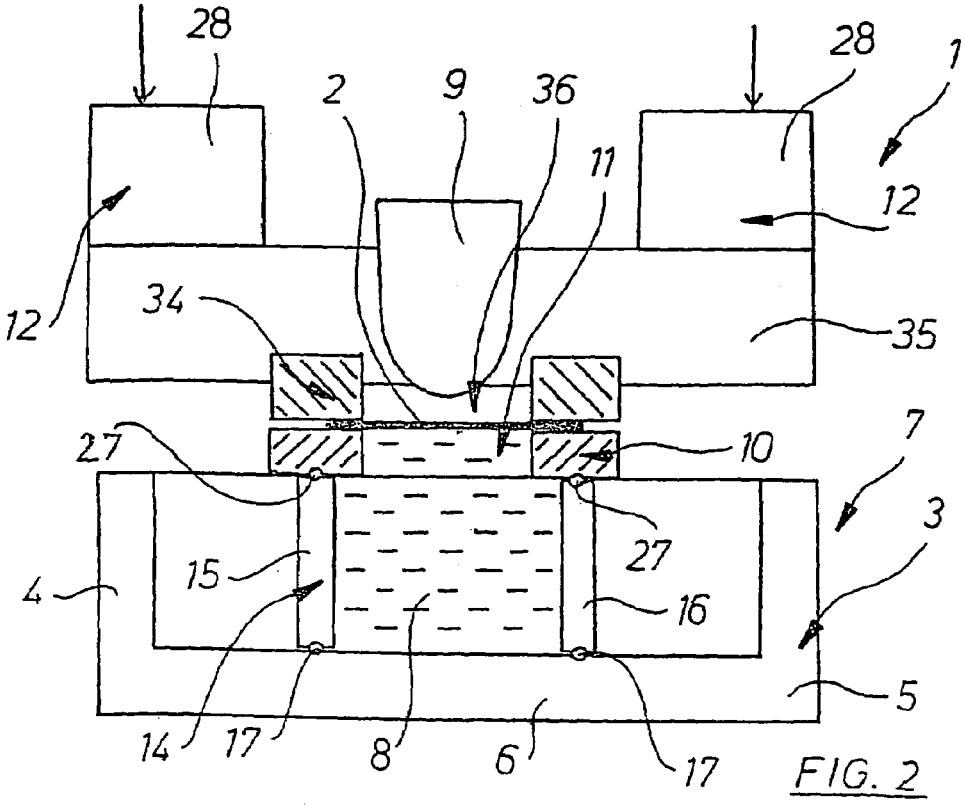

As is shown schematically in FIG. 1 by the arrows 32, 33, in a design corresponding to that of FIG. 1, inelastic and/or elastic deformation of the blank retaining ring 30 may occur as a result of the circumstance that the retaining force of the universal blank holder 28 is applied far outward to the blank retaining ring 30, while the supporting force is situated radially further inward on the edge of the sheet metal blank 2 on the drawing ring 10. In order to avoid this problem, it is proposed for one especially preferred embodiment, shown in FIG. 2, that a stationary receiving ring 35 be inserted between the universal blank holder 28 and a blank retaining ring 34, the blank retaining ring 34 being detachably connected to the receiving ring 35. The ring aperture 36 of the receiving ring 35 is approximately as large as that of the blank retaining ring 34 and overlaps its, that is, it is mounted immediately above the ring aperture 11 of the drawing ring 10. The stationary receiving ring 35 is detachably connected to the universal blank holders 28 on its ring side areas. With a design such as this the forces arising in the blank holders 12, 13 are essentially absorbed in the stationary receiving ring 35 without deformations.

What is claimed is:

1. A forming tool for hydromechanically deep-drawing workpieces from sheet metal blanks, comprising:

a lower tool consisting of a water tank with tank side walls and a tank bottom, wherein the water tank is a tool trough filled with a liquid active medium and a drawing die, a plate-shaped drawing ring having a ring aperture mounted in an upper area of the water tank and sealed off by a ring area from a portion of the active medium, an edge of the ring aperture forming drawing edges for the sheet metal blanks, a drawing stamp movable by means of an adjustable driver rod which is displaceable through the ring aperture into the active medium, wherein pressure impinges on the drawing ring by selective displacement of the active medium during a drawing process, and an actuatable blank holder for mounting the edges of the sheet metal blank to be shaped, wherein the blank holder slides during application of retaining pressure by the drawing stamp, wherein a water tank insert is mounted in the water tank, wherein the tank insert is filled with only a portion of the active medium, and the drawing ring is positioned by a ring area of the drawing ring tightly against upper edges of insert side walls of the water tank insert, and wherein the water tank insert has a tubular shape and insert side walls thereof are positioned on the tank bottom having at least one circumferential lower wall edge seal mounted therebetween.

2. The shaping tool as claimed in claim 1 ,wherein the water tank insert is introduced into the water tank as an insert container having insert side walls and an insert bottom.

3. The shaping tool as claimed in claim 1, wherein a height of the insert side walls corresponds to a height of the tank side walls.

4. The shaping tool as claimed in claim 1, wherein spacers are mounted on an exterior of the insert side walls, maintaining a distance from adjacent interior sides of tank walls, in such a way that the water tank insert may be introduced into the water tank positively locked in one position and be retrieved from the same position.

5. The shaping tool as claimed in claim 1, wherein the blank holder is mounted above the tank side walls, and wherein the blank holder comprises a replaceable blank retaining ring having a ring aperture which corresponds approximately to the ring aperture of the respective drawing ring and is detachably connected by a ring area to the blank holder.

6. The shaping tool as claimed in claim 5, wherein a stationary receiving ring is introduced between the blank holder and the blank retaining ring and the blank retaining ring is detachably connected to the receiving ring, a ring aperture of the receiving ring is at least as large as a ring aperture of the blank retaining ring and is mounted immediately above the ring aperture of the drawing ring, and wherein the receiving ring is detachably connected to the blank holder.

7. The shaping tool as claimed in claim 3, wherein a height of the insert side walls corresponds to a height of the tank side walls.

8. The shaping tool as claimed in claim 2, wherein a height of the insert side walls corresponds to a height of the tank side walls.

* * * * *

UNITED STATES PATENT AND TRADEMARK OFFICE

CERTIFICATE OF CORRECTION

PATENT NO. : 7,007,531 B2
APPLICATION NO. : 10/469582
DATED : March 7, 2006
INVENTOR(S) : Donhauser et al.

It is certified that error appears in the above-identified patent and that said Letters Patent is hereby corrected as shown below:

Page 1, item (75) Inventors is incorrect as it only lists the first two inventors. There are five inventors for the claimed subject and attached herewith is a copy of the Declaration filed for this application showing the names of the inventors to be:

Christian Donhauser, Neufahrn (DE)
Wolfgang Rauh, Kosching (DE)
Mathias Mangliers, Bad Rappenau (DE)
Ali Kaya, Ingolstadt (DE)
Matthias Golle, Pechbrunn (DE)

Signed and Sealed this

Eighth Day of August, 2006

JON W. DUDAS
*Director of the United States Patent and Trademark Office*